US007699634B2

(12) United States Patent
Kholodenko et al.

(10) Patent No.: US 7,699,634 B2
(45) Date of Patent: Apr. 20, 2010

(54) HIGH POWER ELECTRICAL CONNECTOR FOR A LAMINATED HEATER

(75) Inventors: Arnold Kholodenko, San Francisco, CA (US); Russell Martin, Livermore, CA (US); John Rasnick, Los Gatos, CA (US); Christopher Kimball, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 326 days.

(21) Appl. No.: 11/687,344

(22) Filed: Mar. 16, 2007

(65) Prior Publication Data

US 2008/0227323 A1 Sep. 18, 2008

(51) Int. Cl.
*H01R 13/52* (2006.01)

(52) U.S. Cl. ..... 439/278; 439/700; 439/824

(58) Field of Classification Search ..... 439/278, 439/700, 824

See application file for complete search history.

(56) References Cited

U.S. PATENT DOCUMENTS

| | | | | |
|---|---|---|---|---|
| 3,750,084 | A * | 7/1973 | Gardner | 439/277 |
| 6,635,114 | B2 * | 10/2003 | Zhao et al. | 118/715 |
| 6,736,668 | B1 * | 5/2004 | Kholodenko et al. | 439/487 |
| 2007/0215285 | A1 * | 9/2007 | Kimball et al. | 156/345.48 |

* cited by examiner

*Primary Examiner*—Hae Moon Hyeon
(74) *Attorney, Agent, or Firm*—Womble Carlyle

(57) ABSTRACT

An electrical connector has a non-conductive outer housing and a spring-loaded conductive assembly mounted within. The non-conductive outer housing has a longitudinal axis along which the spring-loaded conductive assembly is allowed to move over a limited range, in either direction. The conductive assembly includes a conductive contact pad and an conductive elongated shaft which are mated together within the non-conductive outer housing. A spring mounted along the contact shaft and in abutment therewith biases the contact shaft in a direction away from the contact base. When the electrical connector is employed in a chamber lid of a chamber lid assembly having an integrated laminated heater, such as for use in conjunction with a wafer processing chamber, the spring biases a lower surface of the contact shaft against the heater.

14 Claims, 10 Drawing Sheets

HIGH POWER ELECTRICAL CONNECTOR FOR A LAMINATED HEATER

FIELD OF THE INVENTION

The present invention relates to a electrical connector capable of carrying current to a heater. The connector is especially suited to deliver current to a thin film laminated heater of the sort found in a chamber lid for a wafer processing chamber.

SUMMARY OF THE INVENTION

Generally speaking the present invention is directed to an electrical connector of the sort used to provided electric current through a processing chamber lid, such as a lid used in conjunction with a wafer processing chamber.

In one aspect, the present invention is directed to a processing chamber electrical connector having a longitudinal axis defining a forward to rear direction. Such an electrical connector comprises an electrically insulating connector housing having a forward surface and a rear surface; an electrically insulating sleeve extending along the longitudinal axis and projecting from the rear surface of the connector housing; an electrically insulating relief housing extending along the longitudinal axis and projecting from the forward surface of the connector housing; an electrically conductive contact shaft occupying the sleeve, the contact shaft having a forward end terminating above the rear surface of the connector housing, and a rear end provided with at least one electrical contact; and a spring occupying a portion of the hollow sleeve cavity between the electrically conductive contact shaft and the electrically insulating sleeve, the spring biasing the contact shaft towards the rear direction.

In another aspect, the present invention is directed to a processing chamber lid assembly comprising a processing chamber lid having an upper surface and an underside, with a top electrode module provided on the underside, the top electrode module including at least one heater. A plurality of the aforementioned electrical connectors are fixed in the chamber lid with at least one electrical contact of each electrical connector contacting the at least one heater (150).

BRIEF DESCRIPTION OF THE DRAWINGS

The present invention is described with respect to one or more preferred embodiments using a number of figures in which.

DETAILED DESCRIPTION OF PREFERRED EMBODIMENT

Figure 1:
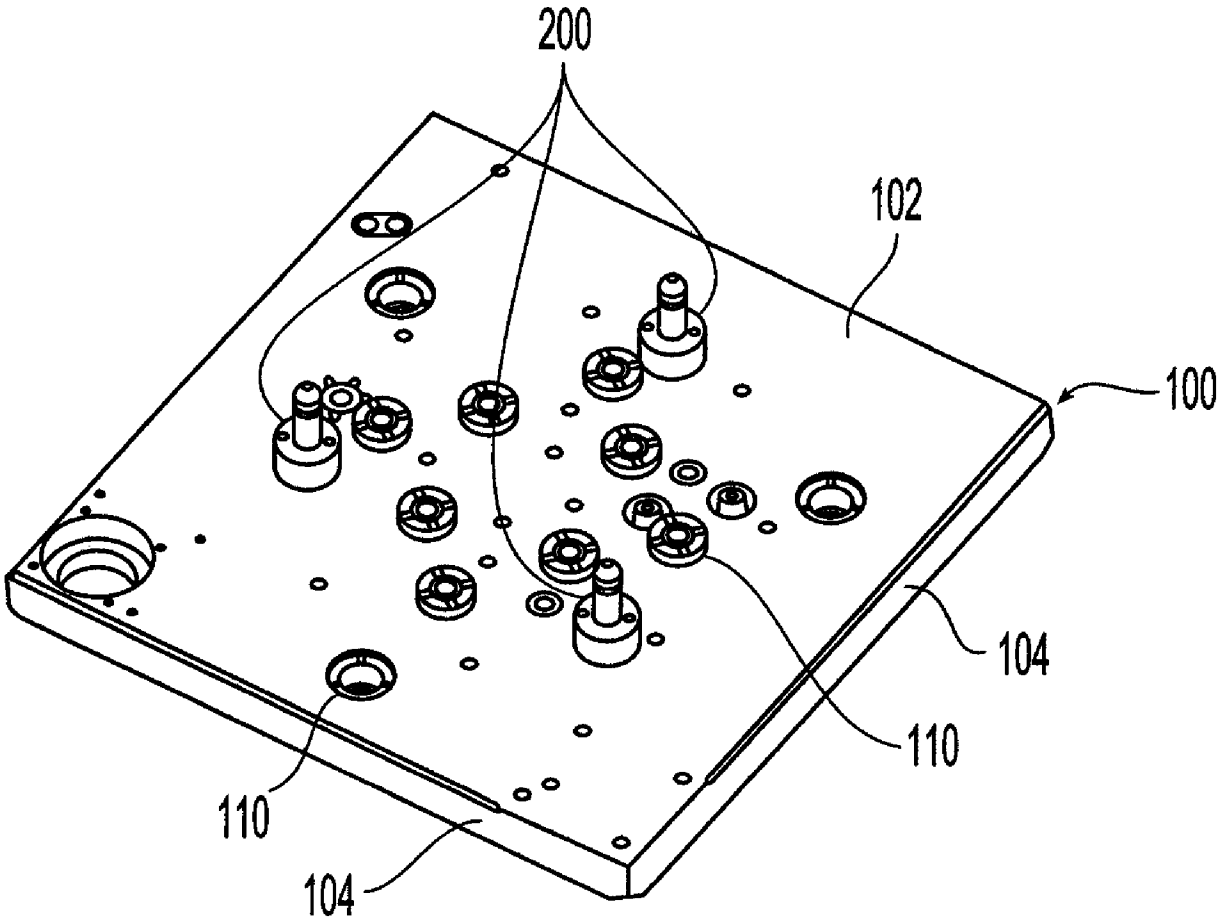
FIG. 1 shows a top perspective view of a chamber lid in accordance with the present invention.

FIG. 1 shows a perspective view of processing chamber lid 100 having generally square upper surface 102 and four side surfaces 104. In one embodiment, the chamber lid 100 is configured to seal a top opening to a wafer processing chamber, such as a chamber configured to conduct semiconductor processing. The chamber lid 100 is provided with a plurality of openings, shown generally as 110 to accommodate various conduits, devices and fixtures for supplying one or more gases, chemicals, vacuum and the like, all in a known manner. A plurality of electrical connectors 200, each in accordance with one embodiment of the present invention, are secured to the chamber lid 100.

As seen in the embodiment of FIG. 1, a total of three such electrical connectors 200 are provided, and these are spaced apart from one another. In one embodiment, the three electrical connectors are spaced apart so as to form a triangle that is centered around the middle of the chamber lid. The triangle formed by the three electrical connectors may be an equilateral triangle. The three connectors may be used to supply three-phase electrical power to a heating element, as described further below.

Figure 2:
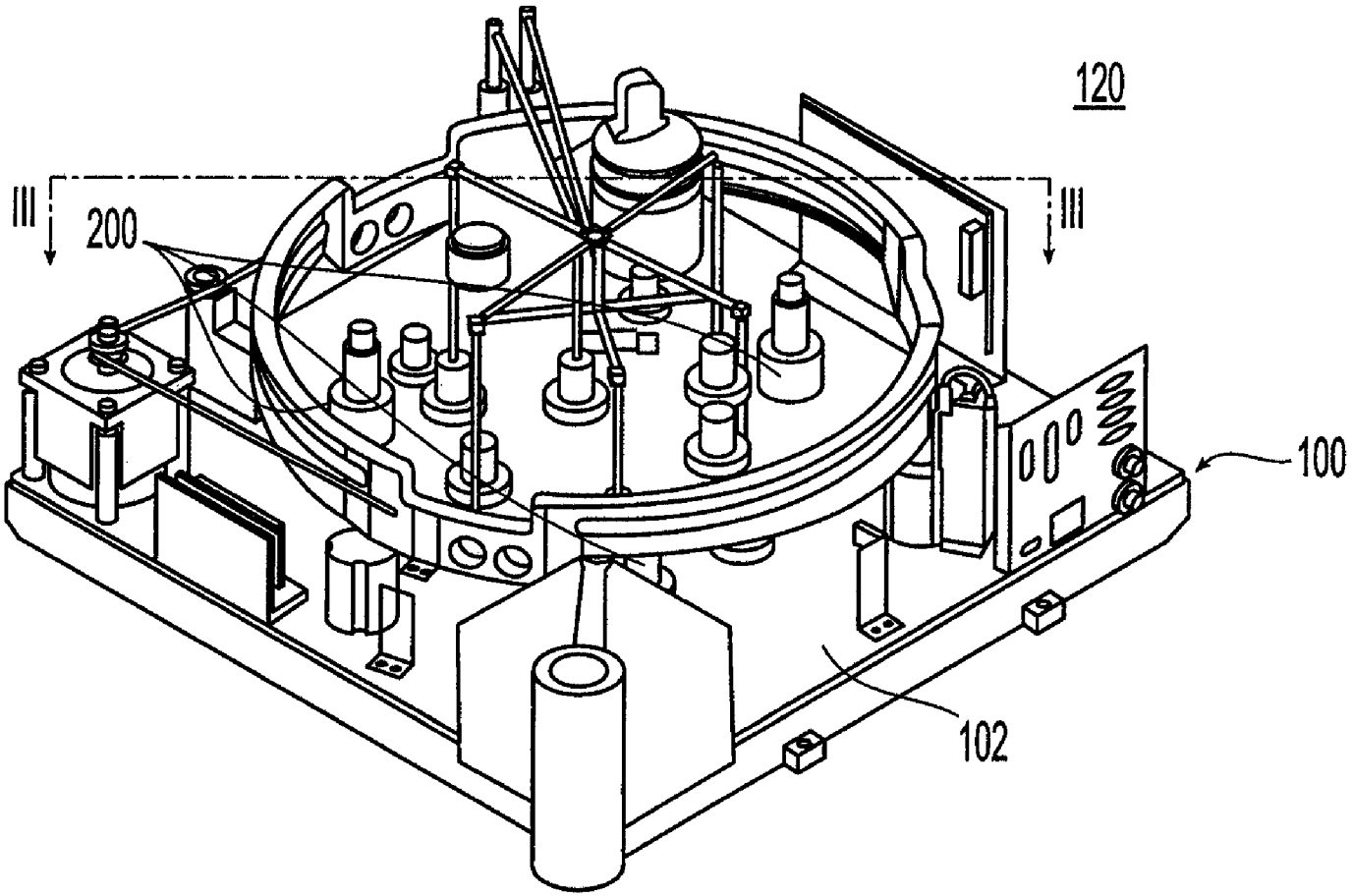
FIG. 2 shows a top perspective view of a chamber assembly lid in accordance with the present invention.

FIG. 2 shows a chamber lid assembly 120 (shown here with its cover removed) which comprises the chamber lid 100 of FIG. 1, along with a number of other electrical and mechanical components including printed circuit boards, valves and the like mounted on the top surface 102.

Figure 3:
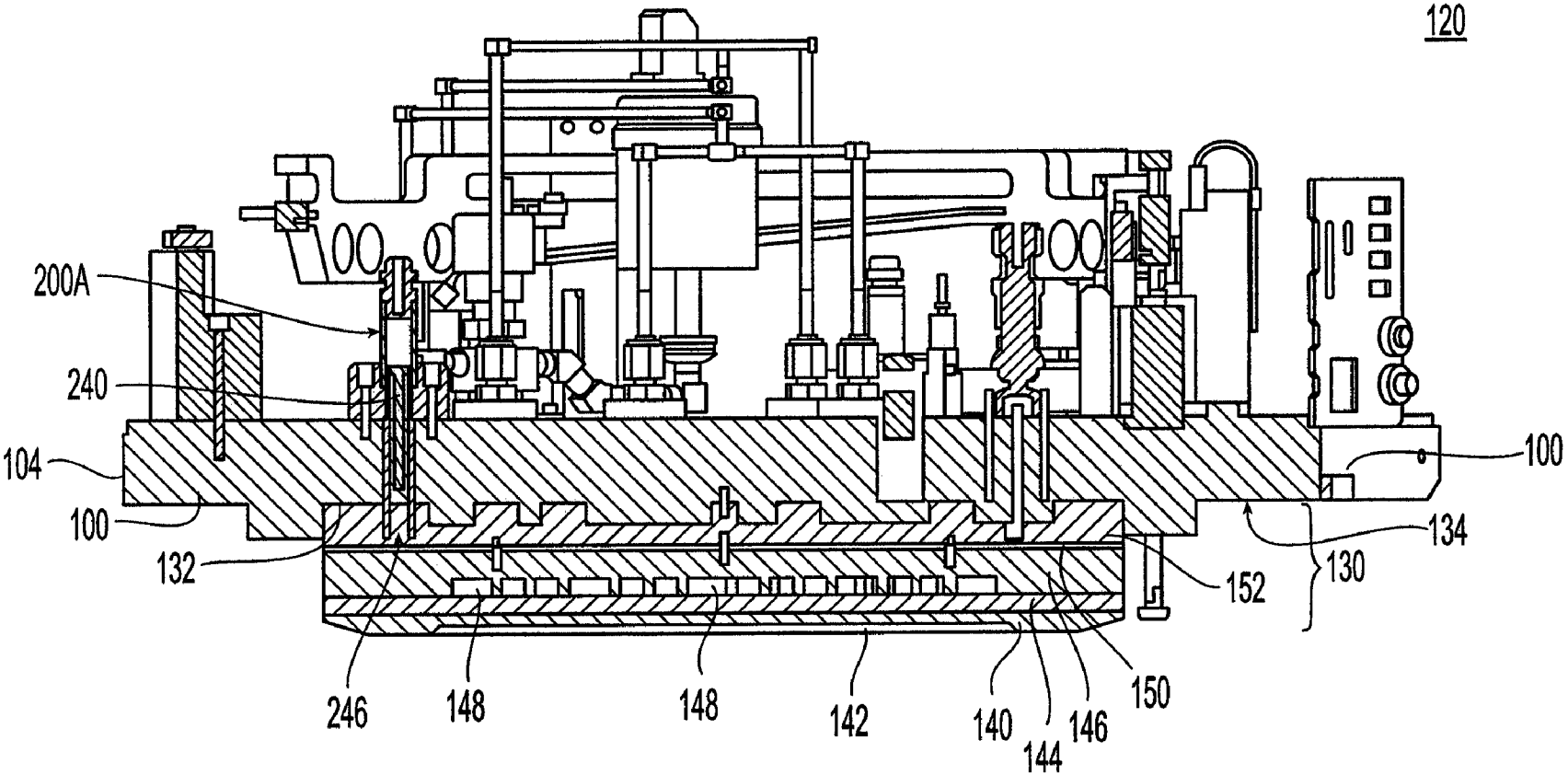
FIG. 3 shows a cross-sectional side view of the chamber lid assembly 120 of FIG. 2 taken along line III-III.

FIG. 3 shows a cross-sectional side view of the chamber lid assembly 120 of FIG. 2 taken along lines III-III, and passing through one electrical connector, designated 200A in this figure. As seen in this figure, the chamber lid assembly 120 comprises the aforementioned chamber lid 100 in combination with a top electrode module 130. The top electrode module 130 is secured to a recess 132 formed on an underside 134 of the chamber lid 100, and set inward of the latter's sides. As such, the top electrode module 130 has a smaller footprint than the chamber lid 100.

The top electrode module 130 comprises a layered structure. In one embodiment, the bottommost layer (which is exposed to the reaction chamber) is a silicon electrode 140. The silicon electrode 140 generally is non-flat, being provided with one or more recesses 142 or other formations, as is known to those skilled in the art. The silicon electrode 140 is secured to a lower backing plate 144, which may be formed of graphite, silica carbide or other material commonly used for such a purpose. The lower backing plate 144, in turn, is secured to a gas distribution plate (e.g., a "showerhead") 146. The gas distribution plate 146 has one or more laterally extending channels 148 formed therein so that gas introduced through the chamber lid 100 emerges more or less evenly across the face of the electrode into the reaction chamber below. The gas distribution plate 146 may also be formed of graphite or silica carbide. An internal heater 150 is sandwiched between the gas distribution plate 146 and a top plate 152, the latter generally being formed of aluminum or other metal.

Figure 9A:
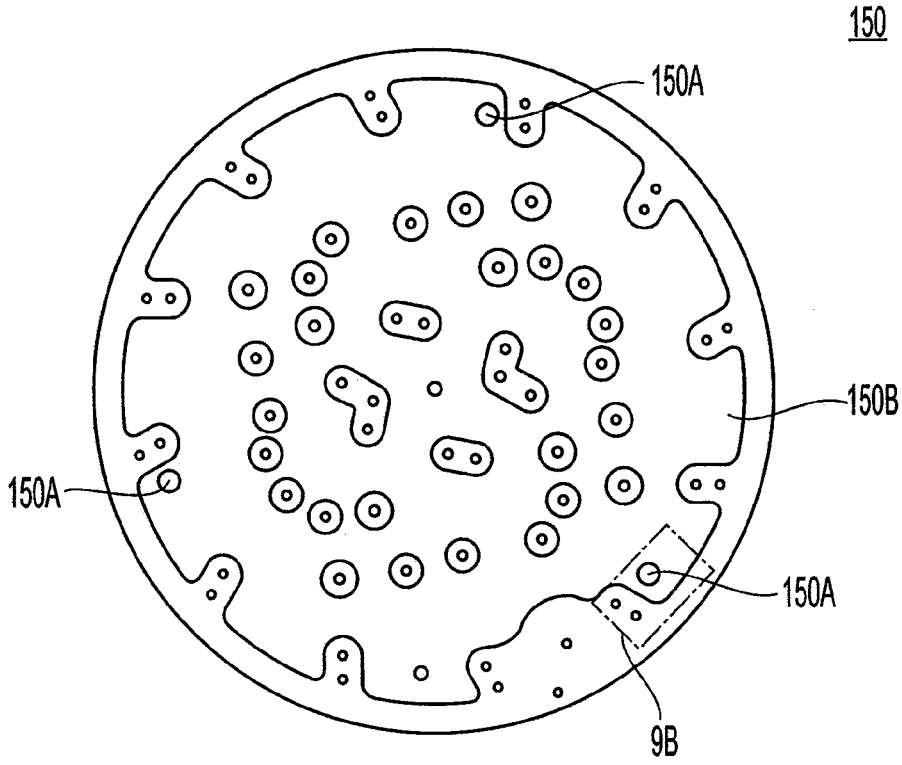
FIGS. 9A and 9B respectively show a perspective view of an upper surface of a heater and an enlarged view of a portion of the heater.
Figure 9B:
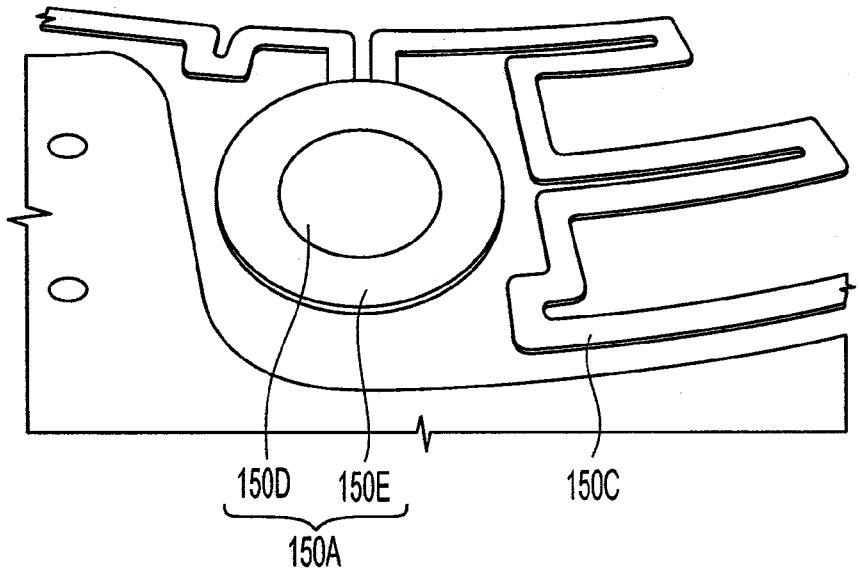

FIGS. 9A and 9B show an embodiment of a heater 150 used with the present invention. The purpose of heater 150 is to elevate the temperature of the reactant gases within the reaction chamber to the range of approximately 150° C.-200° C. Heaters of this sort are known to those skilled in the art. In a preferred embodiment, however, the heater 150 is a disc-shaped three-phase thin film heater comprising one or more generally flat, metallic sheets. The heater 150 includes one or more flat, serpentine sections of conductive wire 150C sandwiched between layers of a electrically insulative, but thermally conductive, film. Exemplary films suitable for this purpose include polyimide films, such as KAPTON®. In the embodiment shown in FIG. 9A, three heater contact pads 150A are evenly circumferentially spaced apart on the upper surface 150B of the electrical heater 150 to provide access for electrically connecting to the heater 150. The heater 150 is also provided with a number of through holes to accommodate various fluid conduits. Each contact pad 150A includes a circular gold-plated central contact portion 150D surrounded by an electrically insulative portion 150E. And while a gold-plated contact is preferred, it is understood, however, that the contact pads may take on other shapes and be formed of other materials.

Figure 8:
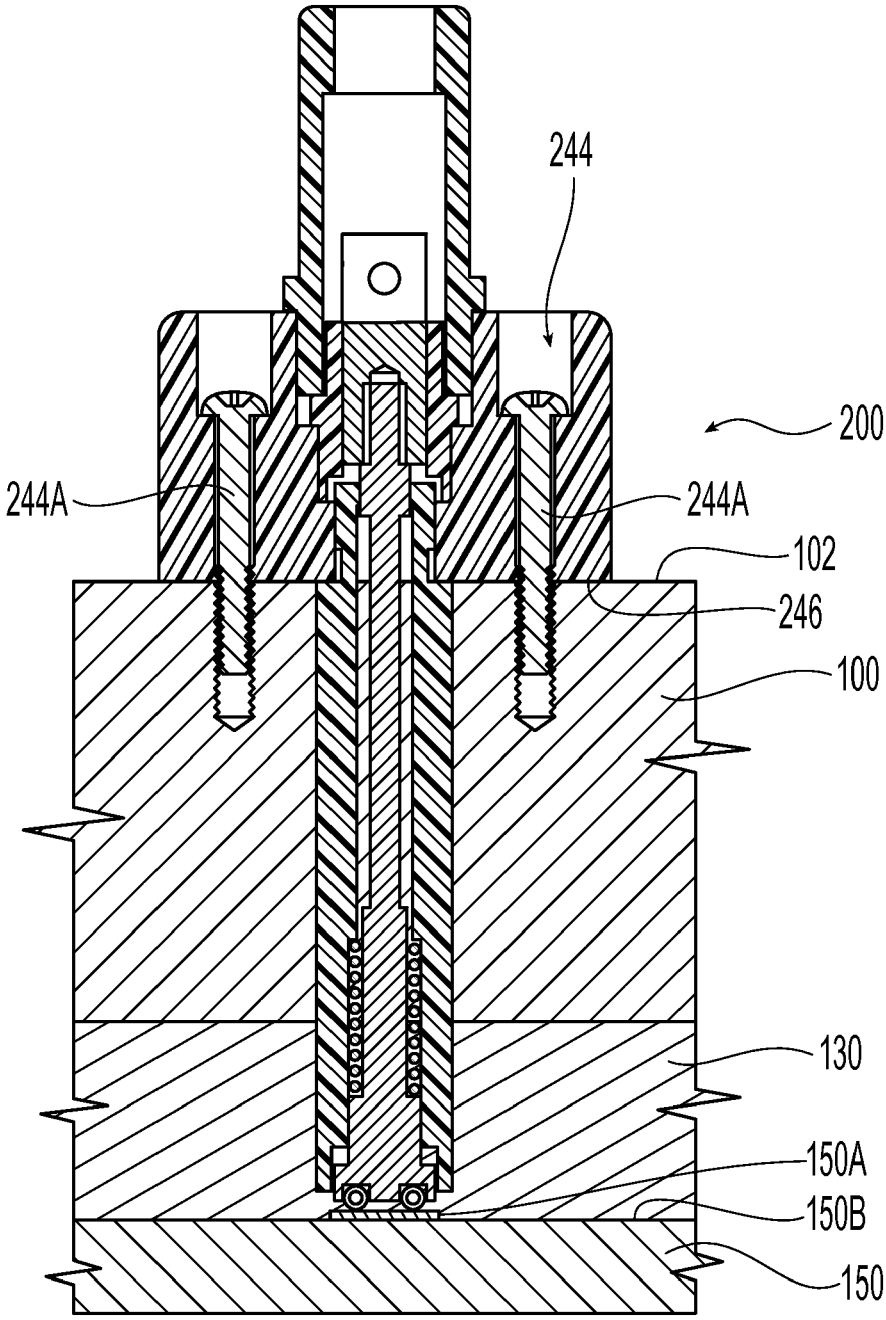
FIG. 8 shows a cross-section of an electrical connector in a chamber lid.
Figure 10A:
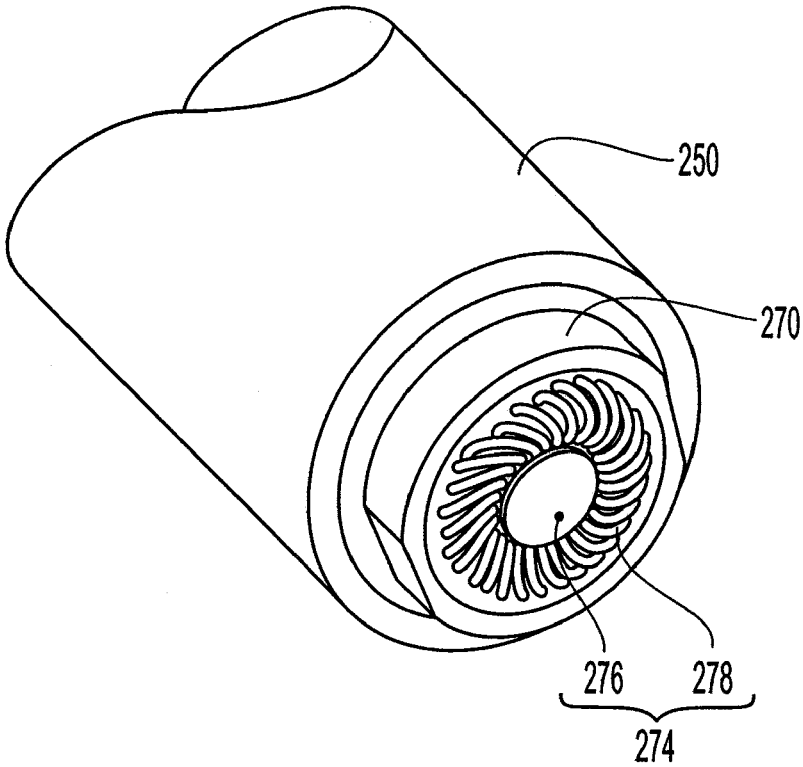
FIG. 10A shows a perspective view of the rear end of an electrical connector.
Figure 10B:
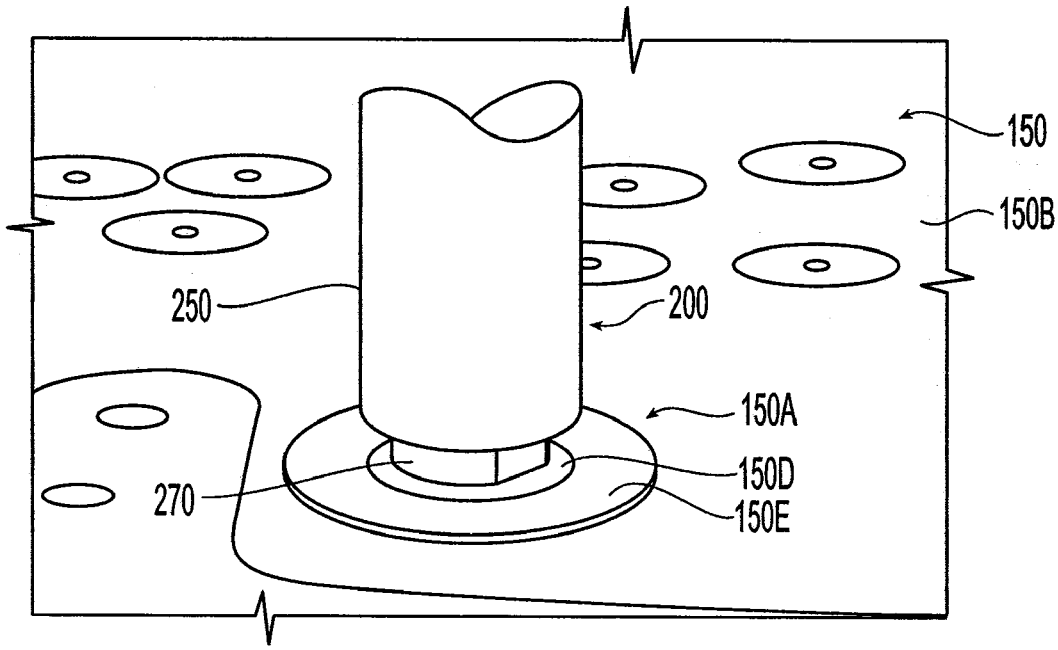
FIG. 10B shows the electrical contact of an electrical connector in contact with a contact pad of electrical heater.

The electrical connector shown in FIG. 3 and designated 200A is retained in the chamber lid 100 by screws 244A passing through screw holes 244 formed in the connector knob housing 240 and into upper surface 102 of the chamber lid 100 (See FIG. 8). The electrical connector 200A passes through the chamber lid 100 and through the top plate 152. As best seen in FIGS. 8, 10A and 10B a bottom end 276 of the electrical connector 200 presses against a heater contact pad 150A (see FIG. 8) of the heater 150, delivering power to the latter. As best seen in FIG. 10B, the central contact portion 150D is slightly larger than a diameter of the connector's electrical contact 274 so that electrical continuity to the heater 150 is maintained, even if there is slight lateral movement of the connector's electrical contact 274 relative to the central contact portion 150D. In one embodiment, on the order of 7.5 KW of power is delivered to the heater 150 via all three electrical connectors contacting the three contact pads 150A.

Because the gas distribution plate 146 and the top plate 152 are formed from different materials, they have different coefficients of thermal expansion. Specifically, a gas distribution plate formed from graphite or ceramics will have a lower coefficient of thermal expansion than a top plate formed from aluminum. Thus, when power is applied to the heater 150, causing its temperature to rise, the gas distribution plate 146 and the top plate 152 expand at different rates, especially in the lateral direction. Due to such thermal expansion, a first point on the heater 150 (which is attached to, and moves with the gas distribution plate 146), may move relative to an opposing point on the top plate. To ensure that the bottom end 276 of electrical connector 200A maintains contact with the heater 150 despite such lateral relative movement, the electrical connector 200A is provided with a spring-loaded arrangement, described next.

Figure 5:
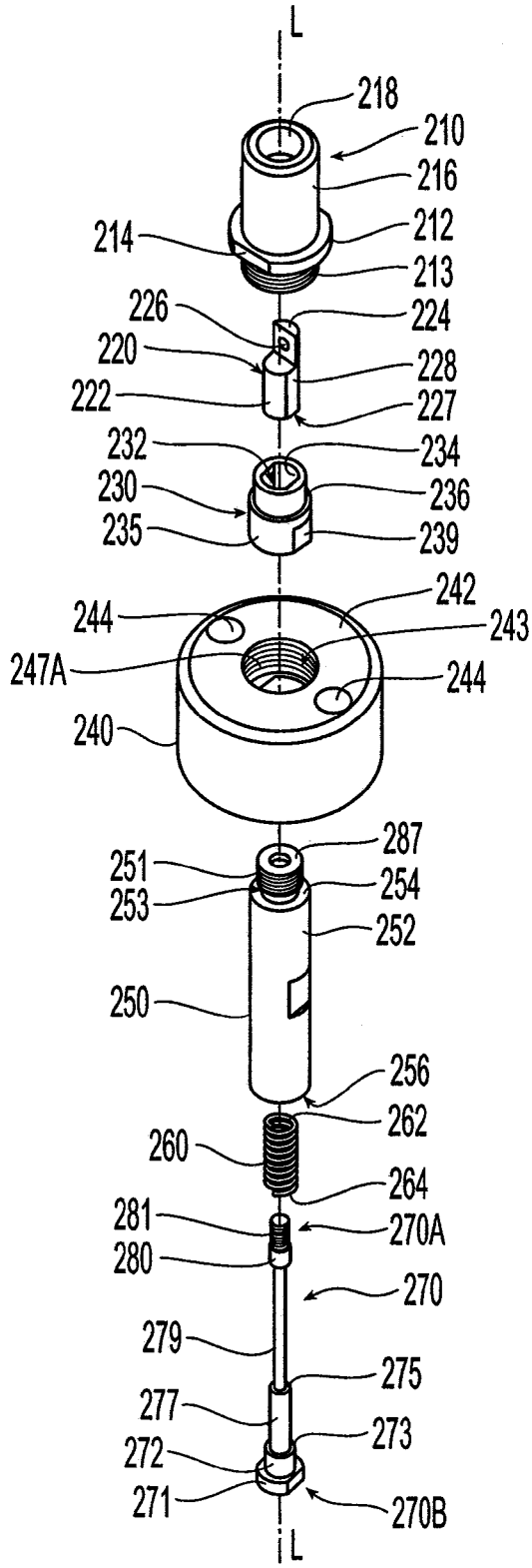
FIG. 5 shows an exploded view of the electrical connector.

FIG. 5 shows an exploded view of an electrical connector 200 in accordance with one embodiment of the present invention. The electrical connector 200 comprises a strain relief housing 210, an electrical contact pad 220, an isolation bushing 230, a connector knob housing 240, a sleeve 250, a spring 260 and a contact shaft 270. All of these components are arranged along a common longitudinal axis L, which defines a forward to rear direction, with the strain relief housing 210 located at the forward end of the connector 200.

The strain relief housing 210, in one embodiment, is a tubular member comprising a substantially annular body 216 having a central opening 218 leading to a relief cavity 219, and a rearwardly facing lower rim 217. A lower portion of the strain relief housing's outer surface is provided with a flange 212 having a pair of oppositely facing indexing surfaces 214 (shown as a flat surface). Below the flange 212, is an external threaded portion 213 which mates with an internal thread 247A of a large diameter portion 247 of the connector knob housing. The first indexing surface 214 principally extends in a direction transverse to the longitudinal axis L. In the assembled electrical connector, the underside 215 of the flange 212 abuts and rests upon the forward surface 242 of the connector knob housing 240 (see FIGS. 6 & 7). The strain relief housing 210 is formed from a non-conductive material, such as a hard plastic.

Figure 6:
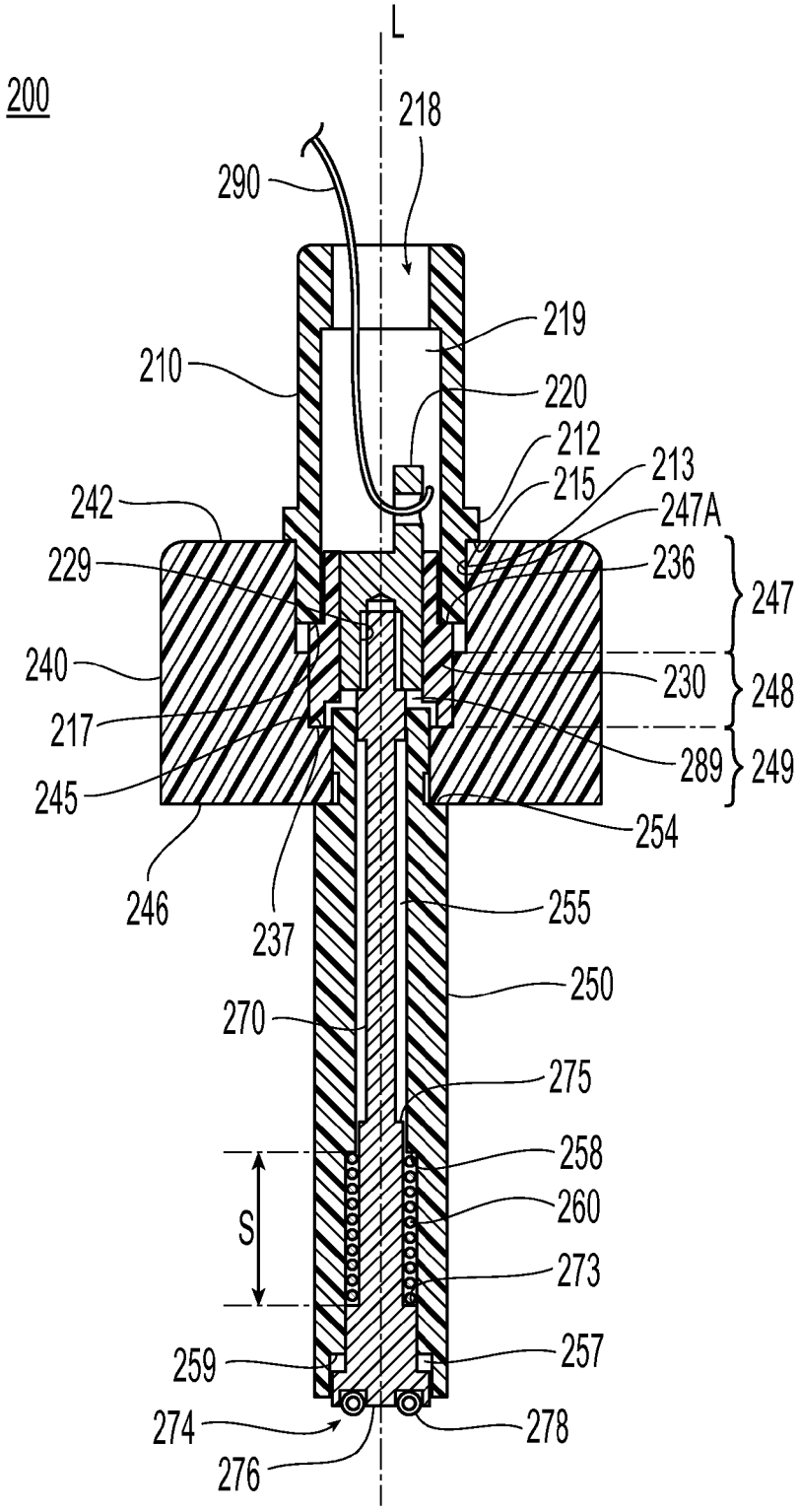
FIG. 6 shows a first cross-sectional view along the length of the electrical connector taken along line VI-VI of FIG. 4A.
Figure 7:
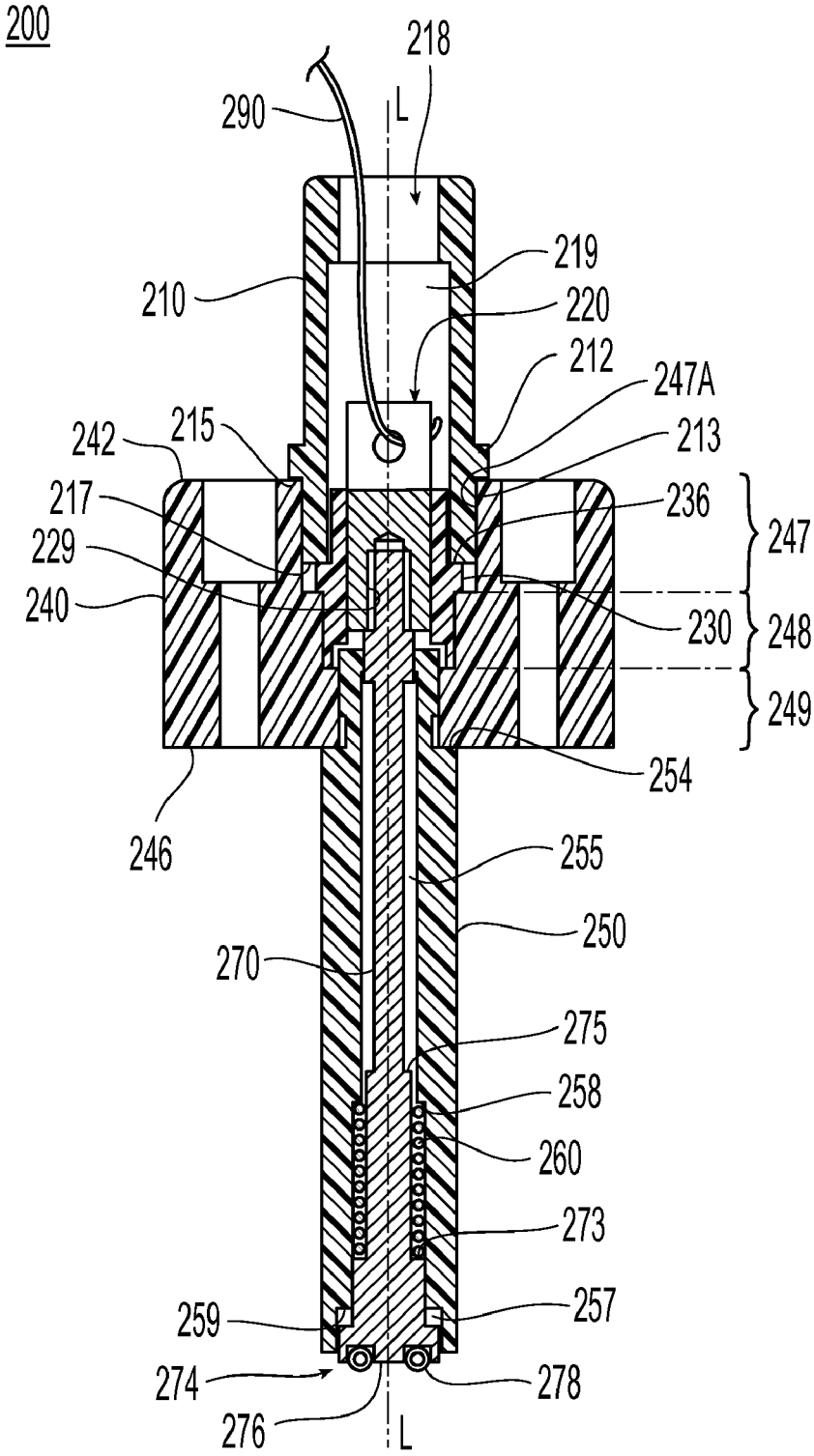
FIG. 7 shows a second cross-sectional view along the length of the electrical connector taken along line VII-VII of FIG. 4A.

The electrical contact pad 220, in one embodiment, comprises a metallic plug body 222 formed with an upwardly projecting tongue 224 having a threaded opening 226 formed therein to facilitate otherwise securing a conductive wire 290 (see FIGS. 6 & 7). While the wire 290 is shown to be loosely inserted into the opening 226, it is understood that in a real implementation, the wire would generally be secured by means of a crimped ring lug (not shown). Nuts, bolts and/or other fixation devices also may be used. The plug body has at least one indexing surface 228 (shown as a flat surface) principally extending along the longitudinal axis L. The bottom 227 of the electrical contact pad 220 is provided with a female threaded portion 229 (see FIGS. 6 & 7).

The isolation bushing 230, in one embodiment, is a tubular member having a central aperture 232. The central aperture 232 is provided with an indexing surface 234. The central aperture 232, with its at least one indexing surface 234, is configured and dimensioned to receive the plug body 222 of the electrical contact pad 220 (see FIGS. 6 and 7), with the one or more indexing surfaces 228 on the plug body 222 facing one or more complementary indexing surfaces 234 on the isolation bushing 230. The lower portion 235 of the bushing 230 is provided with an upwardly facing stepped shoulder 236. The lower portion 235 of the isolation bushing 230 is further provided with one or more lower indexing surfaces 239 and a rearwardly facing rim 237. In the assembled electrical connector 200, the rearwardly facing lower rim 217 of the strain relief housing 210 rests upon the upwardly facing stepped shoulder 236, the one or more lower indexing surfaces 239 permit the isolation bushing to be received with the proper rotational orientation into a medium diameter portion 248 of the connector knob housing 240 (see FIGS. 6 & 7). The isolation bushing 230 is formed from a non-conductive material, such as a hard plastic.

The connector knob housing 240, in one embodiment, comprises a pair of through holes 244 that pass between its forward surface 242 and rear surface 246. Once the electrical connector 200 is fully assembled, it is inserted into a suitable opening in the top surface 102 of the chamber lid 100 until the rear surface 246 of the connector knob housing 240 abuts an adjacent portion of the top surface 102. Then, as seen in FIG. 8, a pair of screws 244A are inserted via the enlarged opening of the through holes 244 in the forward surface 242, to secure the electrical connector 200 to the chamber lid 100. The connector knob housing 240 has a central cavity 243 comprising a stepped internal sidewall. The stepped sidewall has an internally threaded large diameter portion 247 proximate the forward surface 242, a medium diameter portion 248 in a medial portion of the cavity 243, and an internally threaded small diameter portion 249 closest to the rear surface 246. An upwardly facing ledge 245 is formed at the bottom of the medium diameter portion 248. In the assembled electrical connector, the rearwardly facing lower rim 217 of the strain relief housing 210 rests upon the upwardly facing ledge 245. The connector knob housing 240 is formed from a non-conductive material, such as a hard plastic.

The sleeve 250, in one embodiment, comprises an externally threaded sleeve head portion 251 having a first sleeve diameter, an elongated sleeve body portion 252 having a second sleeve diameter that is larger than the first sleeve diameter of the head portion 251, and a sleeve neck portion 253 connecting the two, the sleeve neck portion having a third sleeve diameter which is smaller than either the first or second sleeve diameters. A head top abutment surface 287 is formed at the forward end of the head. Between the sleeve neck 253 and the sleeve body 252, the sleeve 250 is provided with an upwardly facing sleeve shoulder 254. The sleeve 250 further has an elongated hollow sleeve cavity 255 which terminates, at the sleeve base 256 in an enlarged sleeve relief cavity 257. Between the sleeve head portion 251 and the sleeve base 256, the elongated hollow sleeve cavity 255 is stepped. The cavity 255 has a small sleeve cavity cross-section from the sleeve head portion 251 until a rearwardly facing first cavity shoulder 258, a large sleeve cavity cross-section from the rearwardly facing first cavity shoulder 258 to a rearwardly facing second cavity shoulder 259 at the enlarged sleeve relief cavity 257. In the assembled electrical connector 200, the externally threaded sleeve head portion 251 is threadingly received into the small diameter internally threaded portion 249 of the connector knob housing 240. As the two threaded portions are mated to one another, part of the sleeve head portion 251 protrudes past the upwardly facing ledge 245 into the medium diameter portion 248. Ultimately, the sleeve shoulder 254 abuts the rear surface 246 of the connector knob housing 240, preventing the sleeve head portion 251 from being inserted any further into the medium diameter portion 248. The sleeve 250 is formed from a non-conductive material, such as a hard plastic.

The spring 260, in one embodiment, is a compression spring 260 having a spring upper end 262 and a spring lower end 264. The spring 260 is preferably formed of metal and is capable of exerting a spring force of between 5-9 lbs when deflected during normal operation. It is understood that springs formed of other materials and exerting other spring forces may be used instead, depending on the various constraints.

The contact shaft 270 should have good electrical conductivity and poor thermal conductivity because one of its ends will be in contact with the heater 150. It is formed from an electrically conductive material, such as metal, and preferably has unitary construction, being machined or stamped from a single piece. The contact shaft 270 is an elongated member which preferably is machined to have a number of formations thereon. The contact shaft 270 has a forward end 270A which, in the embodiment shown, is provided with a male threaded portion 281, and a rear end 270B. Proximate its rear end 270B, the contact shaft is provided with an enlarged base 271 atop which is a shaft lower boss 272 having a first shaft diameter and a first upwardly facing shaft shoulder 273. A coaxial spring mount 277 having a second shaft diameter extends upwardly from the shaft lower boss 272 and terminates at a second upwardly facing shaft shoulder 275. A narrowed shaft portion 279 having a third shaft diameter extends upwardly from the coaxial spring mount 277 and ends at a shaft upper boss 280. Beyond the shaft upper boss 280, at its forward end, the contact shaft 270 terminates in a male threaded shaft portion 281. The narrowed shaft portion 279 helps reduce the thermal conductivity of the shaft 270.

The rear end 270B of the contact shaft 270 comprises an electrical contact 274 where the electrical connector 200 makes physical contact with the heater 150, to provide electrical current thereto. In one embodiment, to help promote a good electrical connection, the electrical contact 274 may comprise a flat surface 276 surrounded by one or more compressible metal contact springs 278. Exemplary metal contact springs for this purpose include BALCONTACT® springs from Bal Seal Engineering, Inc, which have a toroidal coil construction and can be axially compressed to ensure good electrical contact. In one embodiment, the compressible metal contact springs 278 are selected and configured such that they are capable of accommodating the full current requirements of the heater 150, without the additional benefit of the flat surface 276.

Figure 4A:
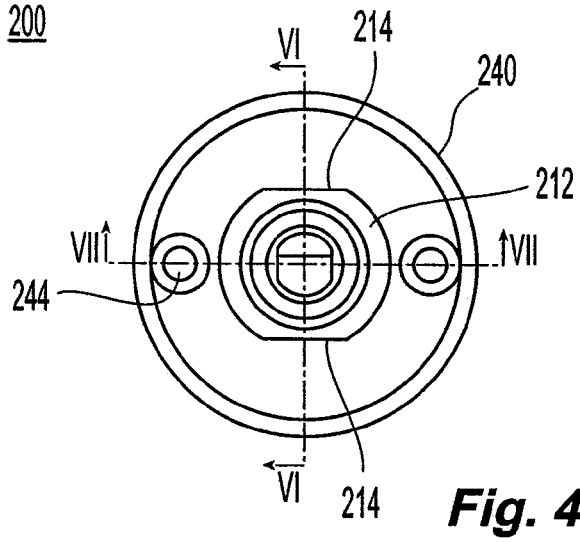
FIG. 4A shows a top view and FIG. 4B shows a side view of an electrical connector in accordance with one embodiment of the present invention.
Figure 4B:
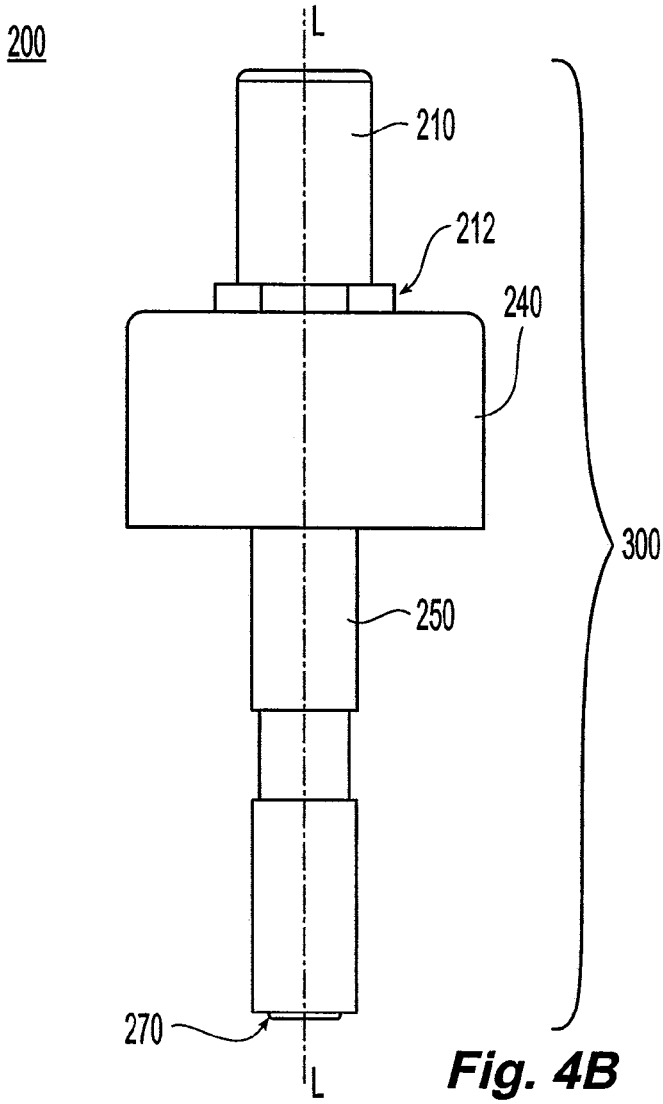

At its forward end, the contact shaft's male threaded portion 281 engages a complementary female threaded portion 229 formed in the bottom of the electrical contact pad 220. Thus, the contact shaft 270 and the electrical contact pad 220 together form a conductive assembly that is able to move along the longitudinal axis L within an non-conductive connector housing 300 (see FIG. 4B) formed by the strain relief housing 210, the connector knob housing 240, and the sleeve 250. Movement of this conductive assembly comprising the contact shaft 270 and the electrical contact pad 220 in either direction compresses the spring 260, providing a restoring force. Movement of the contact shaft 270 and the electrical contact pad 220 in the upwards direction is limited by space within the enlarged sleeve relief cavity 257 between the upper surface of the contact shaft base 271 and the rearwardly facing second cavity shoulder 259. Movement of the contact shaft 270 and the electrical contact pad 220 in the downwards direction is limited by the space 289 between the bottom 227 of the electrical contact pad 220 and the head top abutment surface 287. Meanwhile, the isolation bushing 230 provides a guide in which the electrical contact pad 220 may slide in rectilinear motion along the longitudinal axis L, within the relief cavity 219 of the strain relief housing 210.

While the contact shaft 270 and the electrical contact pad 220 are able to move together along the longitudinal axis, the strain relief housing 210, the connector knob housing 240, and the sleeve 250 remain fixed relative to one another in the assembled electrical connector 200. This is because the sleeve 250 is threadingly engaged to the small diameter portion 249 of the connector knob housing 240, the strain relief housing 210 is threadingly engaged to the internal thread 247A of the large diameter portion 247 of the connector knob housing 240, and isolation bushing 230 is abutted from above by the rearwardly facing lower rim 217 of the strain relief housing 210 and from below by upwardly facing ledge 245 within the cavity 243 of the connector knob housing 240.

In the assembled electrical connector 200, the electrically insulating sleeve 250 extends along the longitudinal axis L and projects from the rear surface 246 of the connector housing 240, while the electrically insulating relief housing 210 extends along the longitudinal axis L and projecting from the forward surface 242 of the connector housing 240. The electrically conductive contact shaft 270 occupies the sleeve 250 with its forward end 270A terminating above the rear surface 246 of the connector housing 240, and its rear end 270B provided with at least one electrical contact 274. The compression spring 260 occupies a portion of the hollow sleeve cavity 255 between the electrically conductive contact shaft 270 and the electrically insulating sleeve 250. The spring 260 biases the contact shaft 270 towards the rear direction.

Also in the assembled electrical connector, the electrical contact pad 220 forms an electrical connection with the forward end 270A of the contact shaft 270 and projects into the relief housing 210. In particular, the forward end 270A of the contact shaft 270 is threadingly engaged to the electrical contact pad 220. Meanwhile, the isolation bushing 230 occupies the central cavity 243 formed in the forward surface 242 of the connector housing 240. The isolation bushing 230 has a central aperture 232 and is retained in the central cavity 243 through abutment by the rearwardly facing lower rim 217 of the relief housing 210. The electrical contact pad 220, while connected to the contact shaft 270, is slidingly accommodated in the central aperture 232 of the isolation bushing 230.

In the embodiment shown, the sleeve 250 is threadingly engaged to a rearward facing side of the electrically insulating connector housing 240, while the relief housing 210 is threadingly engaged to a forward facing side of the connector housing 240. As best seen in FIG. 6, the sleeve 250 has a smaller cross-sectional width than the connector housing 240, and the relief housing 210 also has a smaller cross-sectional width than the connector housing 240. While it is preferred that the electrically insulating connector housing 240 and the electrically insulating sleeve 250 be formed as separate components and then threadingly mated to one another, it is likewise possible that these two components have unitary one-piece construction.

As best seen in FIG. 6, the contact shaft 270 occupies the elongated hollow sleeve cavity 255 with the spring 260 coaxially mounted on the contact shaft's coaxial spring mount 277. The spring upper end 262 abuts the rearwardly facing first cavity shoulder 258, while the spring lower end 264 abuts a first upwardly facing shaft shoulder 273. In the assembled state, the spring 260 is slightly compressed and has a nominal spring height S (see FIG. 6). Due to this compression, the spring 260 exerts a downward force on the upwardly facing shaft shoulder 273, thus biasing the contact shaft 270 in the rearward direction. When the electrical connector 200 is present in the chamber lid assembly 120, the downward force exerted by spring 260, in combination with the electrical contact 274 provided at the rear end 270B of the contact shaft 270, helps promote a good electrical connection to the heater 150 (See FIG. 8).

And, as seen in FIG. 3, the assembled processing chamber lid assembly 102 comprises a processing chamber lid 100 having an upper surface 102 and an underside 134, with a top electrode module 130 provided on the underside 134, the top electrode module 130 including at least one heater 150. A plurality of the aforementioned electrical connectors 200 are fixed in the chamber lid 100 with at least one electrical contact 274 of each electrical connector 200 contacting the at least one heater 150.

Although the present invention has been described to a certain degree of particularity, it should be understood that various alterations and modifications could be made without departing from the scope of the invention as hereinafter claimed.

What is claimed is:

1. A processing chamber electrical connector (200) having a longitudinal axis (L) defining a forward to rear direction, and comprising:

an electrically insulating connector housing (240) having a forward surface (242) and a rear surface (246);

an electrically insulating sleeve (250) extending along the longitudinal axis (L) and projecting from the rear surface (246) of the connector housing (240);

an electrically insulating relief housing (210) extending along the longitudinal axis (L) and projecting from the forward surface (242) of the connector housing (240);

an electrically conductive contact shaft (270) disposed in a hollow sleeve cavity (255) formed in the sleeve (250), the contact shaft (270) having a forward end (270A) terminating above the rear surface (246) of the connector housing (240), and a rear end (270B) provided with at least one electrical contact (274); and a spring (260) occupying a portion of the hollow sleeve cavity (255) between the electrically conductive contact shaft (270) and the electrically insulating sleeve (250), the spring (260) biasing the contact shaft (270) towards the rear direction.

2. The electrical connector according to claim 1, further comprising:

an electrical contact pad (220) forming an electrical connection with the forward end (270A) of the contact shaft (270) and projecting into the relief housing (210).

3. The electrical connector according to claim 2, wherein:

the forward end (270A) of the contact shaft (270) is threadingly engaged to the electrical contact pad (220).

4. The electrical connector according to claim 2, further comprising:

an isolation bushing (230) occupying a central cavity (243) formed in the forward surface (242) of the connector housing (240), the isolation bushing (230) having a central aperture (232) and being retained in the central cavity (243) by said relief housing (210).

5. The electrical connector according to claim 4, wherein:

the electrical contact pad (220) is slidingly accommodated in the central aperture (232) of the isolation bushing (230).

6. The electrical connector according to claim 5, wherein:

the electrically insulating sleeve (250) is threadingly engaged to a rearward facing side of the electrically insulating connector housing (240), the sleeve (250) having a smaller cross-sectional width than the connector housing (240); and the electrically insulating relief housing (210) is threadingly engaged to a forward facing side of the electrically insulating connector housing (240), the relief housing (210) having a smaller cross-sectional width than the connector housing (240).

7. The electrical connector according to claim 6, wherein:

the electrical contact (274) comprises a metal contact spring (278).

8. The electrical connector according to claim 7, wherein:

the forward end (270A) of the contact shaft (270) is threadingly engaged to the electrical contact pad (220).

9. The electrical connector according to claim 1, wherein:

the electrical contact (274) comprises a compressible metal contact spring (278).

10. The electrical connector according to claim 1, further comprising:

an isolation bushing (230) occupying a central cavity (243) formed in the forward surface (242) of the connector housing (240), the isolation bushing (230) having a central aperture (232) and being retained in the central cavity (243) by said relief housing (210).

11. The electrical connector according to claim 1, wherein:

the electrically insulating sleeve (250) is threadingly engaged to a rearward facing side of the electrically insulating connector housing (240), the sleeve (250) having a smaller cross-sectional width than the connector housing (240); and the electrically insulating relief housing (210) is threadingly engaged to a forward facing side of the electrically insulating connector housing (240), the relief housing (210) having a smaller cross-sectional width than the connector housing (240).

12. The electrical connector according to claim 1, wherein:

the electrically insulating connector housing (240) and the electrically insulating sleeve (250) have unitary construction.

13. The electrical connector according to claim 11, wherein:

the electrical contact (274) comprises a compressible metal contact spring (278).

14. A processing chamber lid assembly (102) comprising:

a processing chamber lid (100) having an upper surface (102) and an underside (134), a top electrode module (130) provided on said underside (134), the top electrode module (130) including at least one heater (150); and a plurality of processing chamber electrical connectors (200) fixed to the chamber lid (100); wherein:

each electrical connector has a longitudinal axis (L) defining a forward to rear direction, and comprises:

an electrically insulating connector housing (240) having a forward surface (242) and a rear surface (246);

an electrically insulating sleeve (250) extending along the longitudinal axis (L) and projecting from the rear surface (246) of the connector housing (240);

an electrically insulating relief housing (210) extending along the longitudinal axis (L) and projecting from the forward surface (242) of the connector housing (240);

an electrically conductive contact shaft (270) disposed in a hollow sleeve cavity (255) formed in the sleeve (250), the contact shaft (270) having a forward end (270A) terminating above the rear surface (246) of the connector housing (240), and a rear end (270B) provided with at least one electrical contact (274); and a spring (260) occupying a portion of the hollow sleeve cavity (255) between the electrically conductive contact shaft (270) and the electrically insulating sleeve (250), the spring (260) biasing the contact shaft (270) towards the rear direction; and the at least one electrical contact (274) of each electrical connector (200) contacts the heater (150).

* * * * *